United States Patent [19]

Nakano et al.

[11] Patent Number: 4,480,617

[45] Date of Patent: Nov. 6, 1984

[54] VALVE OPERATION CONTROL APPARATUS IN INTERNAL COMBUSTION ENGINE

[75] Inventors: Yoshikatsu Nakano, Kawagoe; Masaaki Matsuura, Tokyo, both of Japan

[73] Assignee: Honda Giken Kogyo Kabushiki Kaisha, Tokyo, Japan

[21] Appl. No.: 440,528

[22] Filed: Nov. 10, 1982

[30] Foreign Application Priority Data

Nov. 11, 1981 [JP] Japan ..... 56-179583
Nov. 11, 1981 [JP] Japan ..... 56-179584
Nov. 11, 1981 [JP] Japan ..... 56-179585

[51] Int. Cl.[3] ..... F02B 15/00

[52] U.S. Cl. ..... 123/432; 123/90.16; 123/308

[58] Field of Search ..... 123/432, 308, 90.16

[56] References Cited

U.S. PATENT DOCUMENTS 3,547,087 12/1970 Siegler ..... 123/90.16
4,258,671 3/1981 Takizawa et al. ..... 123/90.16
4,285,310 8/1981 Takizawa et al. ..... 123/432

FOREIGN PATENT DOCUMENTS 2901186 7/1980 Fed. Rep. of Germany ..... 123/432
47-31724 8/1972 Japan ..... 123/432

*Primary Examiner*—Ethel R. Cross
*Attorney, Agent, or Firm*—Armstrong, Nikaido, Marmelstein & Kubovcik

[57] ABSTRACT

The present invention is directed to a valve operation control apparatus for use in an internal combustion engine. The device comprises a cylinder with at least two intake or two exhaust valves, one of the two valves including a pause member for holding the valve in a closed position. The control apparatus comprises a control circuit operatively coupled to the pause member. The control circuit has at least two open degree sensors responsive to two different degrees of opening of a throttle valve of the engine and at least two engine speed sensors responsive to two different speeds of the engine, wherein the control circuit controls the operation of the pause member in response to predetermined combinations of the operation of the open degree sensors and the engine speed sensors.

7 Claims, 4 Drawing Figures

VALVE OPERATION CONTROL APPARATUS IN INTERNAL COMBUSTION ENGINE

BACKGROUND OF THE INVENTION

Field of the Invention

This invention relates to an apparatus for control of operation of an intake or exhaust valve means in an internal combustion engine primarily for use in a vehicle.

The applicants in this application have disclosed in Japanese Patent Application No. 141715/Showa 56 (1981) (not prior art herein) a cylinder of an internal combustion engine with at least two intake or exhaust valves, in which either one of the two valves is provided with a pause means for stopping the opening and closing of the valve and keeping the same in its closed position so that the engine output characteristics may be improved. The pause means is operated when the engine is in its low speed range. In the apparatus the engine speed and the throttle valve open degree are detected as analog signals and the pause means is controlled in operation in accordance with a predetermined data matrix. This analog type arrangement, however, is inconvenient in that it is necessary to provide a CPU (Central Processing Unit) as a control means and consequently the apparatus is expensive.

SUMMARY OF THE INVENTION

The present invention is directed to a valve operation control apparatus for use in an internal combustion engine. The device comprises a cylinder with at least two intake or two exhaust valves, one of the two valves including a pause means for holding the valve in a closed position. The control apparatus comprises a control circuit operatively coupled to the pause means. The control circuit has at least two open degree sensors responsive to two different degrees of opening of a throttle valve of the engine and at least two engine speed sensors responsive to two different speeds of the engine, wherein the control circuit controls the operation of the pause means in response to predetermined combinations of the operation of the open degree sensors and the engine speed sensors.

DETAILED DESCRIPTION OF THE PREFERRED EMBODIMENT

Figure 1:
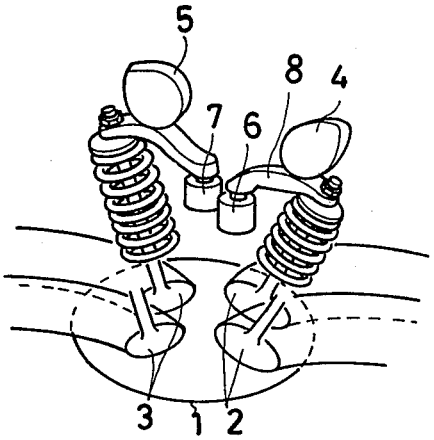
FIG. 1 is a partial perspective view of one embodiment of the present invention.

Referring to FIG. 1, an internal combustion engine of a vehicle has a cylinder 1 with two intake valves 2 on one side thereof and two exhaust valves 3 on the other side thereof. Intake cam 4 is provided above the intake valves on the one side for driving each intake valve 2 and an exhaust cam 5 is provided above the exhaust valves 3 on the other side for driving each exhaust valve 3.

One of the two intake valves 2, that is, the valve 2 positioned on the upper side as viewed in FIG. 1 has a pause means 6 for stopping the opening and closing operations of the valve and keeping the valve in its closed position. Additionally, one of the two exhaust valves 3, that is, the valve 3 on the upper side in FIG. 1, has a pause means 7 for stopping the opening and closing operations of the valve and keeping the valve in its closed position. Thus, if the two pause means 6 and 7 are operated, the intake and exhaust of cylinder 1 are effected through only the intake valve 2 on the lower side and the exhaust valve 3 on the lower side as viewed in FIG. 1.

Figure 2:
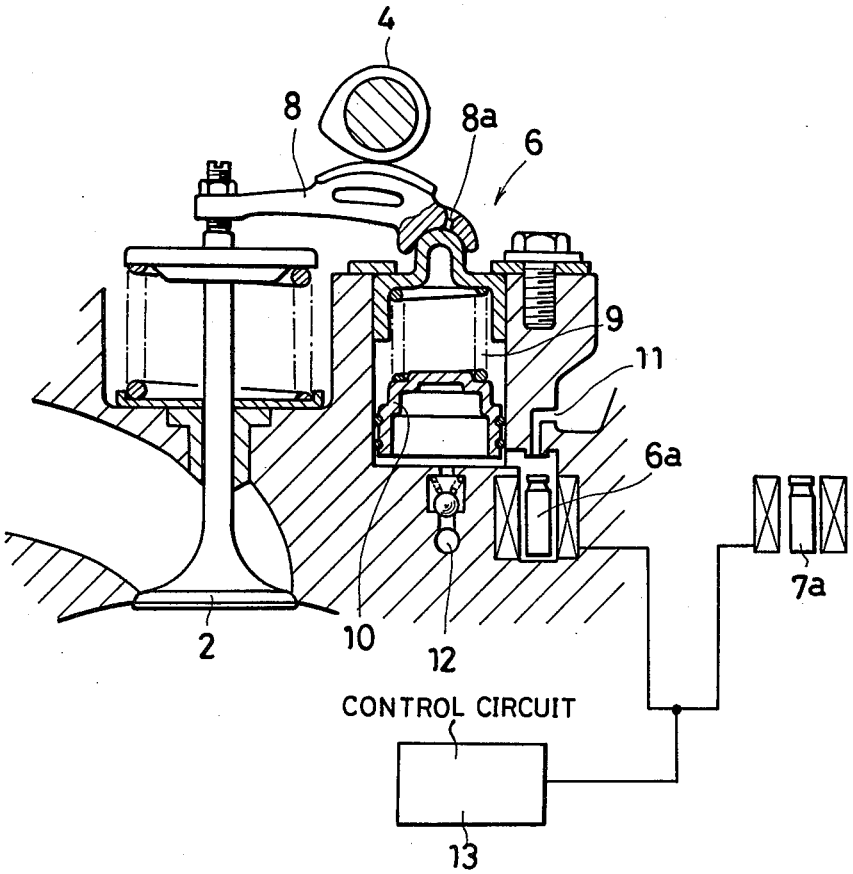
FIG. 2 is a sectional side view of a pause means of the present invention.

As shown clearly in FIG. 2, the pause means 6 comprises an electromagnetic valve **6*a* arranged to be closed on energization thereof. When the valve 6*a* is opened, a control cylinder 10 for supporting, through a spring 9, a pivot point 8*a* of a rocker arm 8 on the upper side of the valve 2 is opened at its outlet opening 11, and thereby pressurized oil introduced into the cylinder 10 through an inlet opening 12 is discharged through the outlet opening 11. Thus the internal pressure in the cylinder 10 is decreased and the resilient force of the spring 9 on the upper side thereof is decreased, whereby the arm 8 moves downwards at its pivot point 8*a* so as to be brought into its inoperative condition. In other words, when the valve 6*a* is opened, operation of the valve 2 on the upper side is stopped from opening and closing and is held in its closed position. This operation is similarly applicable to the pause means 7 which also comprises an electromagnetic valve 7*a*** arranged to be closed on energization thereof.

Figure 3:
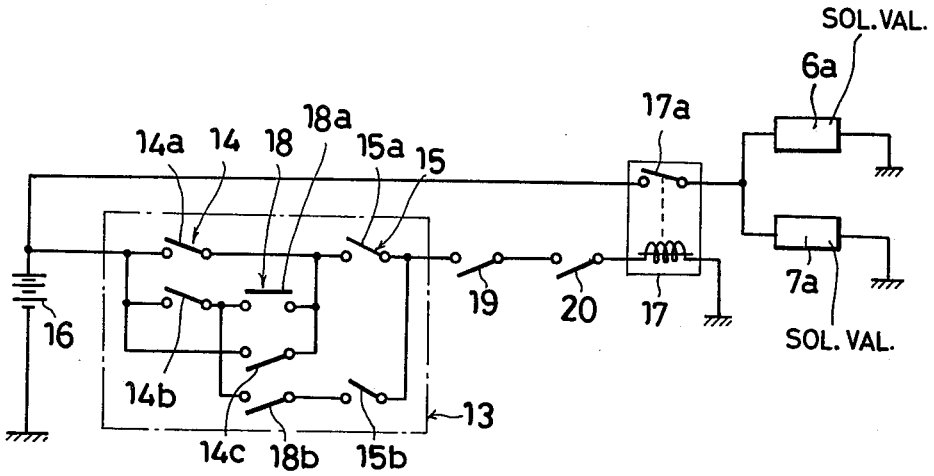
FIG. 3 is a diagram control circuit thereof.

According to the present invention, there is provided a control means for controlling the operations of the pause means 6 and 7. One example thereof is as shown in FIG. 3. Namely, the control means comprises a control circuit 13 with at least two open degree sensors 14 responsive to two different degrees of openings of a throttle valve of the engine and at least two engine speed sensors 15 responsive to two different speeds of revolution of the engine.

The at least two open degree sensors 14 comprise a sensor **14*a* which is a switch that closes when the throttle valve is in a full open condition which is a large open degree, a sensor 14*b* which is a switch that closes when the throttle valve is in a half ($\frac{1}{2}$) open condition which is a middle open degree and a sensor 14*c* which is a switch which closes when the throttle valve is a quarter ($\frac{1}{4}$) open which is a small open degree. The at least two speed sensors 15 comprise a sensor 15*a* which is a switch that closes when the engine is at a comparatively high speed $N_{e1}$, for instance, above 8000 rpm and a sensor 15*b* which is a switch that closes when the engine is at a comparatively low speed $N_{e2}$, that is, above 5000 rpm, for instance. The large open degree sensor 14*a* and the small open degree sensor 14*c* are connected in parallel with each other and in series with the high speed sensor 15*a*, and in parallel therewith the middle open degree sensor 14*b* is connected to the low speed sensor 15*b*. The sensors are connected in a circuit with a relay 17 having a relay contact 17*a* connected between the electromagnetic valves 6*a* and 7*a* and an electric power source 16**.

Figure 4:
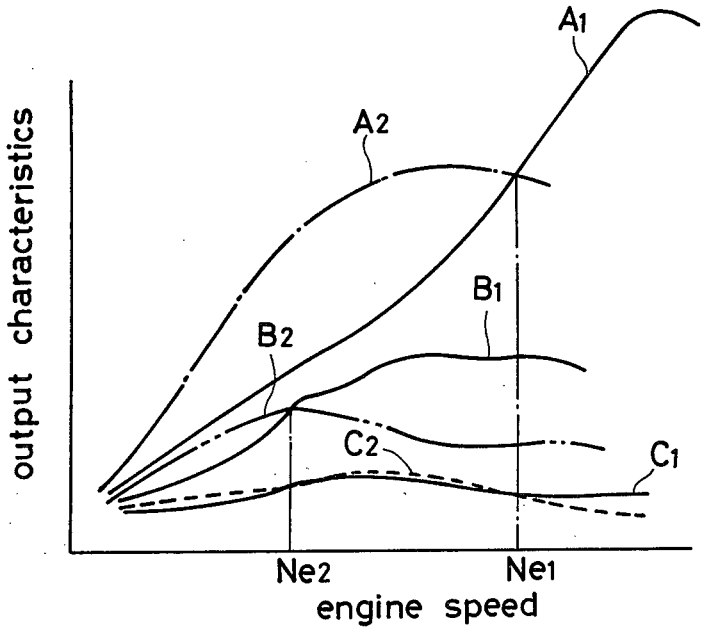
FIG. 4 is a diagram showing engine output characteristics thereof.

In operation, the output characteristics of the engine in the inoperative condition of the pause means 6 and 7 are changed in accordance with a change in throttle valve open degree, as for example shown by a curve $A_1$, a curve $B_1$ and a curve $C_1$ in FIG. 4, respectively, at full open degree, $\frac{1}{2}$ open degree and $\frac{1}{4}$ open degree. When the pause means 6 and 7 are in their operating conditions, the characterstics are shown by a curve $A_2$, a curve $B_2$ and a curve $C_2$, respectively, in FIG. 4.

At the full open degree and at the ¼ open degree, by a combination of each of the large open degree sensor 14*a* and the small open degree sensor 14*c* with the high speed sensor 15*a*, the pause means 6 and 7 are brought into their operative conditions in a low speed range which is below the speed $N_{e1}$. In accordance therewith the output characteristics are changed from the curves $A_1$ and $C_1$ to the curves $A_2$ and $C_2$, respectively and consequently are improved on the lower speed side. At the ½ open degree, by a combination of the middle open degree sensor 14*b* with the low speed sensor 15*b*, the pause means 6 and 7 are similarly brought into their operative conditions in a low speed range which is below the speed $N_{e2}$, and in accordance therewith the output characteristics are changed from the curve $B_1$ to the curve $B_2$, and consequently improved on the low side. Thus, at each throttle open degree, the higher characteristic is selected from the operative conditions of the pause means 6 and 7 and the inoperative conditions of the pause means 6 and 7, in relation to a change in engine speed can be obtained.

In the case where the open degree sensor 14 and the engine speed sensor 15 with the throttle valve being at the ½ open degree, for instance, are combined together as described above to obtain a higher engine output over the whole speed range, the output characteristics are increased as shown by the curve $B_1$ until the engine speed is decreased below the speed $N_{e2}$, and consequently this makes one's deceleration feeling unsatisfactory. For improving this unsatisfactory deceleration feeling, in the illustrated example, at least two negative pressure sensors 18 responsive to two different intake negative pressures of the engine are incorporated in the control circuit 13 so that the combinations between the open degree sensor 14 and the speed sensor 15 may be varied thereby. In the example, the above-mentioned at least two negative pressure sensors 18 comprise a sensor 18*a* which is a switch that closes at a comparatively high negative pressure and a sensor 18*b* which is a switch that closes at a comparatively low negative pressure. The sensor 18*b* is connected between the middle open degree sensor 14*b* and the low speed sensor 15*b*, and the sensor 18*a* is connected in a circuit connected between the middle open degree sensor 14*b* and the high speed sensor 15*a*.

With this arrangement, at the time of accelerating with the throttle valve being at the ½ open degree, when the middle open degree sensor 14*b* and the low speed sensor 15*b* are coupled together by closing the sensor 18*b* due to the increase in intake negative pressure, and the speed reaches above the speed $N_{e2}$, the characteristics are changed from the curve $B_2$ to the curve $B_1$ and consequently the feeling of acceleration is improved. On the other hand, at the time of decelerating with the same throttle valve opening condition, when the middle open degree sensor 14*b* and the high speed sensor 15*a* are coupled together by closing of the sensor 18*a* due to a decrease in intake negative pressure, and the speed falls below the speed $N_{e1}$, the output characteristics are changed from the curve $B_1$ to the curve $B_2$, and consequently the feeling of deceleration is improved.

In the above-described arrangement, when applied to an engine for a vehicle, if the engine is revved up when the vehicle is stopped, the engine switches between its idling operation and its high speed operation, and the operations of the pause means 6 and 7 are repeated each time the engine speed is in a low speed range. This is not only wasteful but also deteriorates the durability of the means 6 and 7. For preventing this, a vehicle speed sensor 19 is provided which is responsive to a comparatively low driving speed of a vehicle, so that the pause means 6 and 7 may be held in their operating conditions by the operation of the sensor 19 without being controlled by the control circuit 13. Additionally, when the pause means 6 and 7 are an oil pressure operated type as described above, and the engine is at a comparatively low temperature, the oil for operating means 6 and 7 becomes comparatively high in viscosity, and consequently if the means 6 and 7 are repeatedly switched between operative and inoperative modes, a poor responsive property occurs and the shock on the means 6 and 7 is increased. Also the durability thereof is liable to be deteriorated. For preventing this, in the illustrated embodiment, a temperature sensor 20 responsive to a comparatively low engine temperature is provided, so that when the sensor 20 is operated, the means 6 and 7 may be held in their operating conditions, without being controlled by the control circuit 13.

The vehicle speed sensor 19 is a switch which is opened when the vehicle speed is below 15 km/h, for instance, and the temperature sensor 20 is a switch which is opened when the oil temperature corresponding to the engine temperature is below 40° C., for instance. The sensors 19 and 20 are connected in series to one with another, in a power circuit between the control circuit 13 and the relay 17. Thus, when the vehicle is in its stopped condition or the engine temperature is low, the means 6 and 7 are held in their operating conditions owing to cutting off of the electric current flowing to the relay 17 by the opening of the sensors 19, 20, and thereby a change between operative and inoperative conditions as described above by the control circuit 13 cannot be made.

Thus, according to this invention, the control circuit has at least two open degree sensors responsive to two different open degrees of a throttle valve and at least two speed sensors responsive to two different engine speeds. The control circuit controls the operation of a pause means by predetermined combinations of the open degree sensors and the speed sensors.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. A valve operation control apparatus for use in an internal combustion engine having a cylinder with at least two intake or two exhaust valve means, one of the two valve means includes a pause means for holding the valve means in a closed position, said control apparatus comprising a control circuit means operatively coupled to said pause means, said control circuit means having at least two open degree sensors responsive to two different degrees of opening of a throttle valve of the engine and at least two engine speed sensors responsive to two different speeds of the engine, wherein said control circuit means controls the operation of said pause means in response to predetermined combinations of the operation of said open degree sensors and said engine speed sensors.

2. A valve operation control apparatus of claim 1, wherein said control circuit means includes at least two negative pressure sensors coupled between said open degree sensors and said speed sensors, and responsive to two different intake negative pressures of the engine wherein the predetermined combinations of the open degree sensors and the engine speed sensors are varied by the operation of said negative pressure sensors.

3. A valve operation control apparatus of claim 2, wherein said at least two open degree sensors comprise three open degree sensors responsive respectively to a large degree of opening, a middle degree of opening and a small degree of opening of the throttle valve, wherein said at least two engine speed sensors comprise two engine speed sensors responsive respectively to a high speed and a low speed of the engine, and wherein said at least two negative pressure sensors comprise two negative pressure sensors responsive respectively to a high negative pressure and a low negative pressure of the engine.

4. A valve operation control apparatus of claim 3, wherein said open degree sensor responsive to the middle degree of opening, the speed sensor responsive to the high speed and the sensor responsive to the high negative pressure are coupled in series and said open degree sensor responsive to the middle degree of opening is coupled, through the sensor responsive to the low negative pressure, in series with said speed sensor responsive to the low speed.

5. A valve operation control apparatus of claim 4, wherein said open degree sensor responsive to the large degree of opening and said open degree sensor responsive to the small degree of opening are connected in parallel said parallel sensors being connected in series with said speed sensor responsive to the high speed.

6. A valve operation control apparatus of any one of claims 1 to 5, including a vehicle speed sensor means responsive to a vehicle speed below a predetermined value, wherein said vehicle speed sensor means is coupled to said pause means for holding said pause means in an operating condition when the vehicle speed is below the predetermined value.

7. A valve operation control apparatus of any one of claims 1 to 5, wherein said pause means is oil pressure operated, said control apparatus including a temperature sensor responsive to an engine temperature below a predetermined temperature, wherein said temperature sensor means is coupled to said pause means for holding said pause means in an operating condition when the engine temperature is below the predetermined temperature.

* * * * *